US008444434B2

(12) United States Patent
Davis et al.

(10) Patent No.: US 8,444,434 B2
(45) Date of Patent: May 21, 2013

(54) GROUNDING STRUCTURES FOR HEADER AND RECEPTACLE ASSEMBLIES

(75) Inventors: Wayne Samuel Davis, Harrisburg, PA (US); Robert Neil Whiteman, Jr., Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 134 days.

(21) Appl. No.: 13/182,214

(22) Filed: Jul. 13, 2011

(65) Prior Publication Data

US 2013/0017725 A1 Jan. 17, 2013

(51) Int. Cl.
*H01R 13/648* (2006.01)

(52) U.S. Cl.
USPC ..... 439/607.07

(58) Field of Classification Search
USPC ..... 439/607.05–607.07
See application file for complete search history.

(56) References Cited

U.S. PATENT DOCUMENTS

| | | | | |
|---|---|---|---|---|
| 6,293,827 | B1 * | 9/2001 | Stokoe | 439/607.07 |
| 6,551,140 | B2 * | 4/2003 | Billman et al. | 439/607.07 |
| 7,410,393 | B1 * | 8/2008 | Rothermel et al. | 439/607.05 |
| 7,585,186 | B2 * | 9/2009 | McAlonis et al. | 439/607.05 |
| 7,811,128 | B2 * | 10/2010 | Pan | 439/607.05 |
| 7,862,376 | B2 * | 1/2011 | Sypolt et al. | 439/607.07 |
| 8,187,035 | B2 * | 5/2012 | Davis et al. | 439/607.02 |
| 2008/0096423 | A1 * | 4/2008 | Huang | 439/608 |
| 2009/0247012 | A1 * | 10/2009 | Pan | 439/607.05 |

* cited by examiner

*Primary Examiner* — Gary F. Paumen

(57) ABSTRACT

A receptacle assembly includes a front housing configured for mating with a header assembly. A contact module is coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame supporting the contacts. The dielectric frame is received in the conductive holder. The contacts extend from the conductive holder for electrical termination. A ground shield is coupled to the first side. The ground shield is electrically connected to the conductive holder. The ground shield has grounding beams that extend therefrom. The grounding beams extend forward of the front of the conductive holder for electrical connection to a corresponding header shield of the header assembly. First and second side shields are coupled to the first and second sides, respectively. The first and second side shields are electrically connected to the conductive holder. The first and second side shields have grounding fingers that extend therefrom. The grounding fingers extend forward of the front of the conductive holder for electrical connection to a corresponding header shield of the header assembly.

20 Claims, 4 Drawing Sheets

GROUNDING STRUCTURES FOR HEADER AND RECEPTACLE ASSEMBLIES

BACKGROUND OF THE INVENTION

The subject matter herein relates generally to grounding connector assemblies.

Some electrical systems utilize electrical connectors to interconnect two circuit boards, such as a motherboard and daughtercard. In some systems, to electrically connect the electrical connectors, a midplane circuit board is provided with front and rear header connectors on opposed front and rear sides of the midplane circuit board. Other systems electrically connect the circuit boards without the use of a midplane circuit board by directly connecting electrical connectors on the circuit boards.

However, as speed and performance demands increase, known electrical connectors are proving to be insufficient. Signal loss and/or signal degradation is a problem in known electrical systems. Additionally, there is a desire to increase the density of electrical connectors to increase throughput of the electrical system, without an appreciable increase in size of the electrical connectors, and in some cases, a decrease in size of the electrical connectors. Such increase in density and/or reduction in size causes further strains on performance.

In order to address performance, some known systems utilize shielding to reduce interference between the contacts of the electrical connectors. However, the shielding utilized in known systems is not without disadvantages. For instance, electrically connecting the grounded components of the two electrical connectors at the mating interface of the electrical connectors is difficult and defines an area where signal degradation occurs due to improper shielding at the interface. For example, some known systems include ground contacts on both electrical connectors that are connected together to electrically connect the ground circuits of the electrical connectors. Typically, the connection between the ground contacts is located at a single point of contact.

A need remains for an electrical system that provides efficient shielding to meet particular performance demands. A need remains for an electrical system that provides redundant grounding connections.

BRIEF DESCRIPTION OF THE INVENTION

In one embodiment, a receptacle assembly is provided having a front housing that is configured for mating with a header assembly. A contact module is coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame supporting the contacts. The dielectric frame is received in the conductive holder. The contacts extend from the conductive holder for electrical termination. A ground shield is coupled to the first side. The ground shield is electrically connected to the conductive holder. The ground shield has grounding beams that extend therefrom. The grounding beams extend forward of the front of the conductive holder for electrical connection to a corresponding header shield of the header assembly. First and second side shields are coupled to the first and second sides, respectively. The first and second side shields are electrically connected to the conductive holder. The first and second side shields have grounding fingers that extend therefrom. The grounding fingers extend forward of the front of the conductive holder for electrical connection to a corresponding header shield of the header assembly.

In another embodiment, a receptacle assembly is provided having a front housing that is configured for mating with a header assembly. The front housing has contact openings therethrough. A contact module is coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame supporting the contacts. The dielectric frame is received in the conductive holder. The contacts extend from the conductive holder into corresponding contact openings for electrical termination to header contacts of the header assembly. A ground shield is coupled to the first side. The ground shield is electrically connected to the conductive holder. The ground shield has grounding beams that extend therefrom. The grounding beams extend forward of the front of the conductive holder into corresponding contact openings for electrical connection to a wall of a corresponding C-shaped header shield of the header assembly. First and second side shields are coupled to the first and second sides, respectively. The first and second side shields are electrically connected to the conductive holder. The first and second side shields have grounding fingers that extend therefrom. The grounding fingers extend forward of the front of the conductive holder into corresponding contact openings for electrical connection to corresponding edges of the C-shaped header shield of the header assembly.

In a further embodiment, an electrical connector assembly is provided having a header assembly that includes a header housing. A plurality of header contacts are held by the header housing, and a plurality of C-shaped header shields surround corresponding header contacts on three sides. The header shields have walls that define the C-shaped header shields and two edges at the ends of the C-shaped header shields. A receptacle assembly is matable to the header assembly. The receptacle assembly includes a front housing that is matable to the header housing. A contact module is coupled to the front housing. The contact module includes a conductive holder that has a first side and an opposite second side. The conductive holder has a front coupled to the front housing. The conductive holder holds a frame assembly. The frame assembly includes a plurality of contacts and a dielectric frame supporting the contacts. The dielectric frame is received in the conductive holder. The contacts extend from the conductive holder for electrical termination to corresponding header contacts. A ground shield is coupled to the first side with the ground shield being electrically connected to the conductive holder. The ground shield has grounding beams that extend therefrom. The grounding beams extend forward of the front of the conductive holder for electrical connection to a corresponding wall of a corresponding header shield. First and second side shields are coupled to the first and second sides, respectively. The first and second side shields are electrically connected to the conductive holder. The first and second side shields have grounding fingers that extend therefrom. The grounding fingers extend forward of the front of the conductive holder for electrical connection to corresponding edges of the header shield.

DETAILED DESCRIPTION OF THE INVENTION

Figure 1:
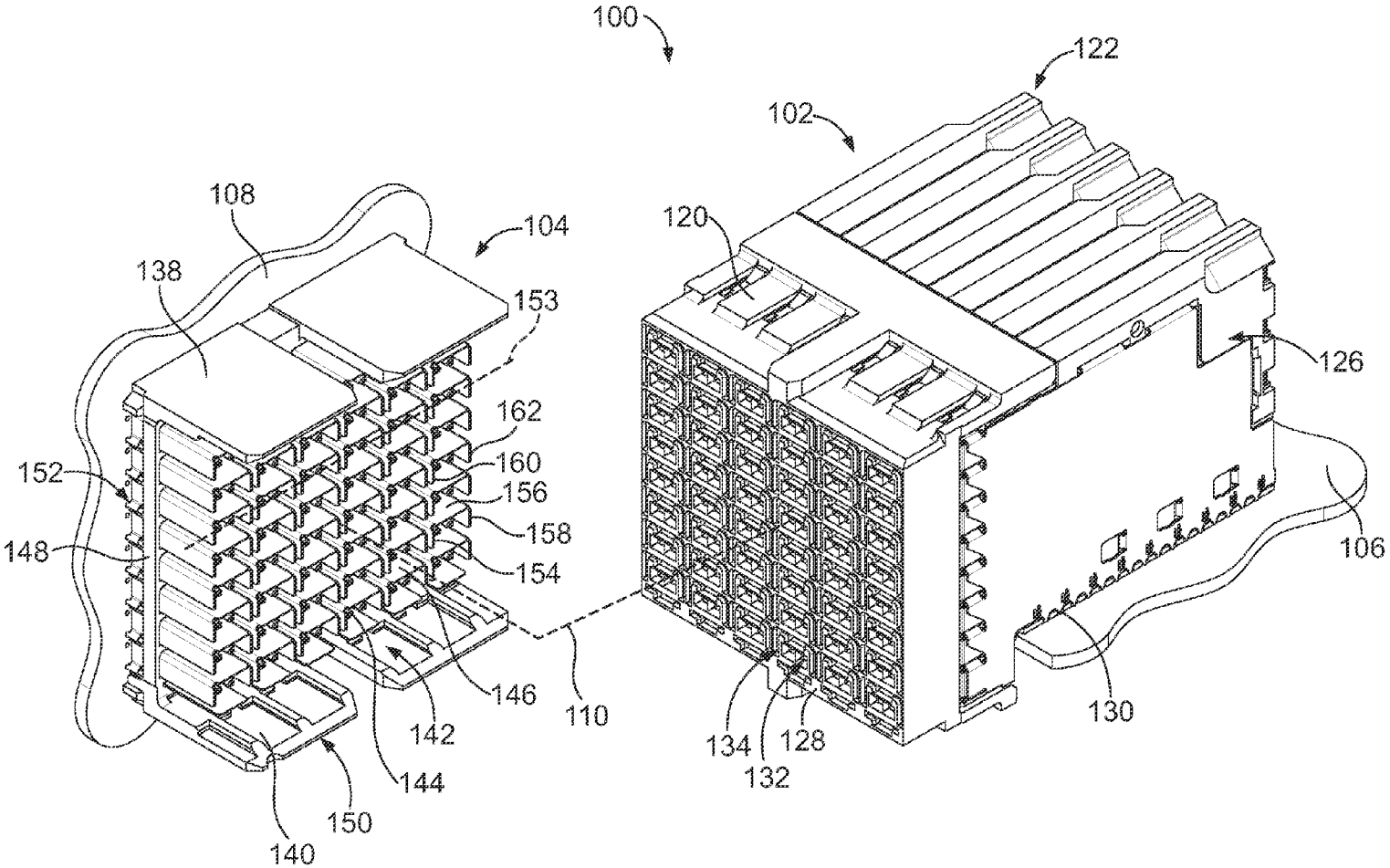
FIG. 1 is a perspective view of an exemplary embodiment of an electrical connector system illustrating a receptacle assembly and a header assembly formed in an exemplary embodiment.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 2) that are received in the front housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the header assembly 104 and/or the circuit board 106. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding beams 302 (shown in FIG. 2) and grounding fingers 340, 370 (both shown in FIG. 2) of the contact modules 122 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The header shields 146 have edges 160, 162 at opposite ends of the header shields 146. The edges 160, 162 are downward facing. The edges 160, 162 are provided at the distal ends of the walls 154, 158, respectively. The bottom is open between the edges 160, 162. The header shield 146 associated with another pair of header signal contacts 144 provides the shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
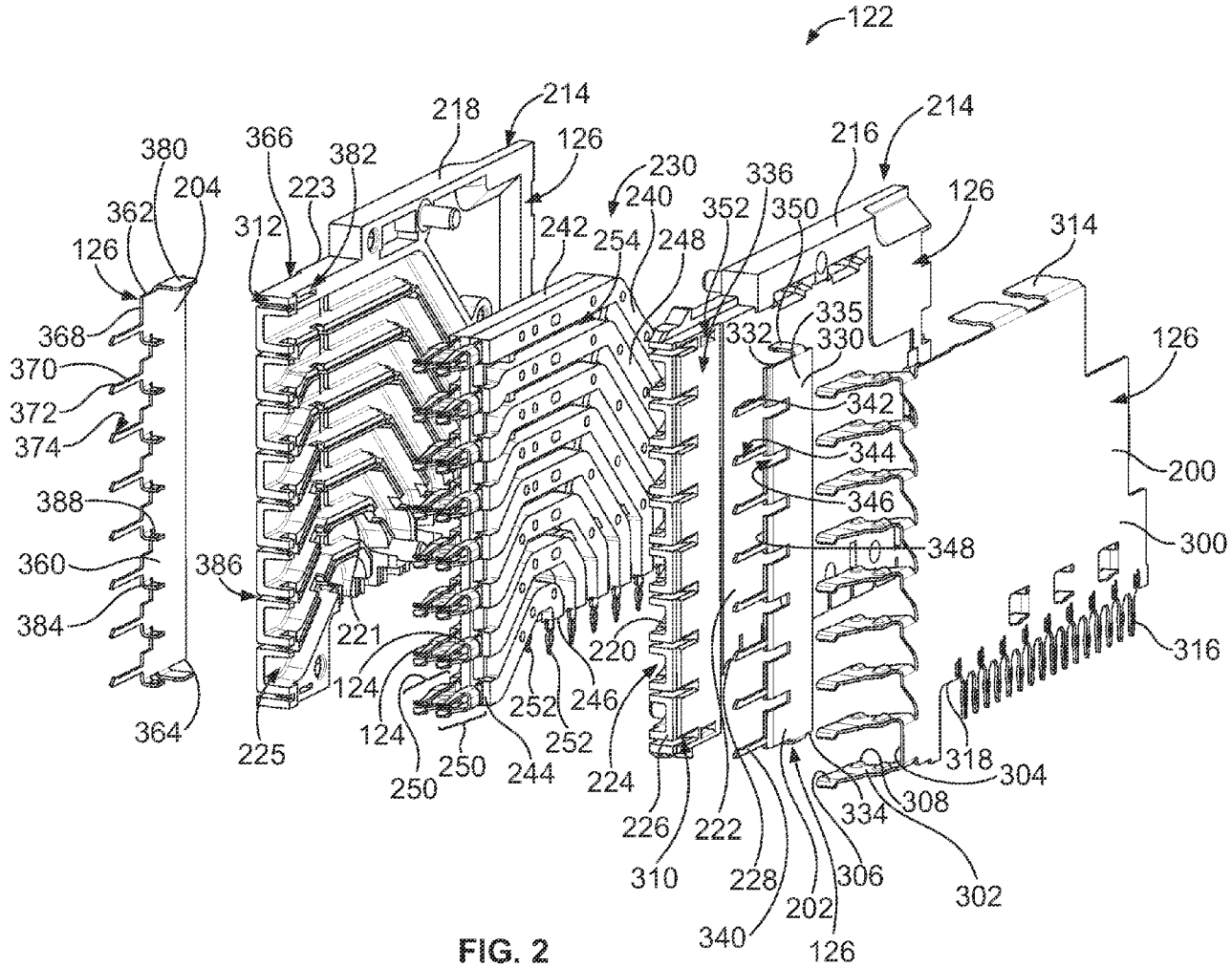
FIG. 2 is an exploded view of a contact module for the receptacle assembly shown in FIG. 1.

FIG. 2 is an exploded view of one of the contact modules 122 and part of the shield structure 126. The shield structure 126 includes a ground shield 200, a first side shield 202 and a second side shield 204. The ground shield 200 and side shields 202, 204 electrically connect the contact module 122 to the header shields 146 (shown in FIG. 1). The ground shield 200 and side shields 202, 204 provide multiple, redundant points of contact to the header shield 146. The ground shield 200 and side shields 202, 204 provide shielding on all sides of the receptacle signal contacts 124.

The contact module 122 includes a holder 214 having a first holder member 216 and a second holder member 218 that are coupled together to form the holder 214. The holder members 216, 218 are fabricated from a conductive material. For example, the holder members 216, 218 may be die-cast from a metal material. Alternatively, the holder members 216, 218 may be stamped and formed or may be fabricated from a plastic material that has been metalized or coated with a metallic layer. By having the holder members 216, 218 fabricated from a conductive material, the holder members 216, 218 may provide electrical shielding for the receptacle assembly 102. When the holder members 216, 218 are coupled together, the holder members 216, 218 define at least a portion of the shield structure 126 of the receptacle assembly 102.

The holder members 216, 218 include tabs 220, 221 extending inward from side walls 222, 223 thereof. The tabs 220 define channels 224 therebetween. The tabs 221 define channels 225 therebetween. The tabs 220, 221 define at least a portion of the shield structure 126 of the receptacle assembly 102. When assembled, the holder members 216, 218 are coupled together and define a front 226 and a bottom 228 of the holder 214.

The contact module 122 includes a frame assembly 230 held by the holder 214. The frame assembly 230 includes the receptacle signal contacts 124. The frame assembly 230 includes a pair of dielectric frames 240, 242 surrounding the receptacle signal contacts 124. In an exemplary embodiment, the receptacle signal contacts 124 are initially held together as lead frames (not shown), which are overmolded with dielectric material to form the dielectric frames 240, 242. Other manufacturing processes may be utilized to form the contact modules 122 other than overmolding a lead frame, such as loading receptacle signal contacts 124 into a formed dielectric body.

The dielectric frame 240 includes a front wall 244 and a bottom wall 246. The dielectric frame 240 includes a plurality of frame members 248. The frame members 248 hold the receptacle signal contacts 124. For example, a different receptacle signal contact 124 extends along, and inside of, a corresponding frame member 248. The frame members 248 encase the receptacle signal contacts 124.

The receptacle signal contacts 124 have mating portions 250 extending from the front wall 244 and contact tails 252 extending from the bottom wall 246. Other configurations are possible in alternative embodiments. The mating portions 250 and contact tails 252 are the portions of the receptacle signal contacts 124 that extend from the dielectric frame 240. In an exemplary embodiment, the mating portions 250 extend generally perpendicular with respect to the contact tails 252. Inner portions or encased portions of the receptacle signal contacts 124 transition between the mating portions 250 and the contact tails 252 within the dielectric frame 240. When the contact module 122 is assembled, the mating portions 250 extend forward from the front 226 of the holder 214 and the contact tails 252 extend downward from the bottom 228 of the holder 214.

The dielectric frame 240 includes a plurality of windows 254 extending through the dielectric frame 240 between the frame members 248. The windows 254 separate the frame members 248 from one another. In an exemplary embodiment, the windows 254 extend entirely through the dielectric frame 240. The windows 254 are internal of the dielectric frame 240 and located between adjacent receptacle signal contacts 124, which are held in the frame members 248. The windows 254 extend along lengths of the receptacle signal contacts 124 between the contact tails 252 and the mating portions 250. Optionally, the windows 254 may extend along a majority of the length of each receptacle signal contact 124 measured between the corresponding contact tail 252 and mating portion 250.

During assembly, the dielectric frame 240 and corresponding receptacle signal contacts 124 are coupled to the holder member 216. The frame members 248 are received in corresponding channels 224. The tabs 220 are received in corresponding windows 254 such that the tabs 220 are positioned between adjacent receptacle signal contacts 124. The dielectric frame 242 and corresponding receptacle signal contacts 124 are coupled to the holder member 218 in a similar manner with the tabs 221 extending through the dielectric frame 242.

The holder members 216, 218, which are part of the shield structure 126, provide electrical shielding between and around respective receptacle signal contacts 124. The holder members 216, 218 provide shielding from electromagnetic interference (EMI) and/or radio frequency interference (RFI). The holder members 216, 218 may provide shielding from other types of interference as well. The holder members 216, 218 provide shielding around the outside of the frames 240, and thus around the outside of all of the receptacle signal contacts 124, such as between pairs of receptacle signal contacts 124, as well as between the receptacle signal contacts 124 using the tabs 220, 221 to control electrical characteristics, such as impedance control, cross-talk control, and the like, of the receptacle signal contacts 124.

The ground shield 200 includes a main body 300. In the illustrated embodiment, the main body 300 is generally planar. The ground shield 200 includes grounding beams 302 extending forward from a front 304 of the main body 300. In an exemplary embodiment, the grounding beams 302 are bent out of plane with respect to the main body 300 such that the grounding beams 302 are oriented perpendicular with respect to the plane defined by the main body 300. In an exemplary embodiment, the ground shield 200 is manufactured from a metal material. The ground shield 200 is a stamped and formed part with the grounding beams 302 being stamped and then bent during the forming process out of plane with respect to the main body 300. Optionally, the main body 300 may extend vertically while the grounding beams 302 may extend horizontally, however other orientations are possible in alternative embodiments.

Each grounding beam 302 has a mating interface 306 at a distal end thereof. The mating interface 306 is configured to engage the corresponding header shield 146. The grounding beam 302 includes one or more projections 308 extending therefrom. The projections 308 are configured to engage the conductive holder 214 when the ground shield 200 is coupled thereto.

In an exemplary embodiment, the holder members 216, 218 include slots 310, 312, respectively, that receive the grounding beams 302 therein when the ground shield 200 is coupled to the side wall 222 of the holder member 216. The projections 308 are received in the slots 310, 312 and engage the holder members 216, 218 to create an electrical connection with the holder members 216, 218. In an exemplary embodiment, the slots 310, 312 are vertically offset with respect to the receptacle signal contacts 124. When the grounding beams 302 are received in the slots 310, 312, the grounding beams 302 are vertically offset with respect to the receptacle signal contacts 124. For example, the grounding beams 302 may be positioned above and/or below corresponding receptacle signal contacts 124. In an exemplary embodiment, the grounding beams 302 are generally aligned with the receptacle signal contacts 124 of both dielectric frames 240, 242. The grounding beams 302 provide electrical shielding between one row of receptacle signal contacts 124 and another row of receptacle signal contacts 124 that is either above or below the other receptacle signal contacts 124. The grounding beams 302 are wide enough to generally cover both columns of receptacle signal contacts 124 to provide shielding for the receptacle signal contacts 124 of both columns.

The ground shield 200 includes a plurality of mounting tabs 314 extending inward from the main body 300. The mounting tabs 314 are configured to be coupled to the holder member 216. The mounting tabs 314 secure the ground shield 200 to the first side wall 222. The mounting tabs 314 engage the holder member 216 to electrically connect the ground shield 200 to the holder member 216. Any number of mounting tabs 314 may be provided. The location of the mounting tabs 314 may be selected to secure various portions of the ground shield 200, such as the top, the back, the front, the bottom, and the like of the ground shield 200 to the holder member 216. The engagement of the projections 308 with the holder 214 help to secure the ground shield 200 to the holder 214. Optionally, the ground shield 200 may engage the holder member 218 in addition to, or in alternative to, the holder member 216.

The ground shield 200 includes a plurality of ground pins 316 extending from a bottom 318 of the ground shield 200. The ground pins 316 are configured to be terminated to the circuit board 106 (shown in FIG. 1). The ground pins 316 may be compliant pins, such as eye-of-the-needle pins, that are throughhole mounted to plated vias in the circuit board 106. Other types of termination means or features may be provided in alternative embodiments to couple the ground shield 200 to the circuit board 106. The grounding beams 302 extend forward from the front 226 of the holder 214 such that the grounding beams 302 may be loaded into the front housing 120 (shown in FIG. 1).

The first side shield 202 is separate and distinct from the ground shield 200. The side shield 202 is manufactured from a metal material. In an exemplary embodiment, the side shield 202 is stamped and formed. The side shield 202 includes a main body 330 extending between a top 332 and a bottom 334. The side shield 202 is configured to be coupled to the side wall 222 of the holder member 216. The side shield 202 is coupled to the holder member 216 at the front 226 of the holder 214. Optionally, the holder member 216 may include a pocket 336 that receives the side shield 202 such that an outer surface 338 of the side shield 202 is generally flush with the side wall 222.

The side shield 202 includes a plurality of grounding fingers 340 extending forward from the main body 330. The grounding fingers 340 extend forward of the front 226 of the holder 214 for electrical connection to the header shield 146. The grounding fingers 340 are configured to be received in the front housing 120. The grounding fingers 340 have mating interfaces 342 at distal ends of the grounding fingers 340. In an exemplary embodiment, the grounding fingers 340 have bumps 344 proximate to the distal ends that are upward facing and that define the mating interfaces 342. The mating interfaces 342 are configured to engage the edges 160 (shown in FIG. 1) of corresponding header shields 146. Optionally, the side shield 202 may be selectively plated, such as at the mating interface 342 to enhance the characteristics of the side shield 202.

The side shield 202 includes slots 346 open at a front 348 of the main body 330. The slots 346 provide an opening for the grounding beams 302. The grounding beams 302 pass through the slots 346 into the slots 310, 312 of the holder members 216, 218.

The side shield 202 is held interior of the ground shield 200. The ground shield 200 may cover at least a portion of the side shield 202. The ground shield 200 may be electrically connected to the side shield 202. Optionally, the ground shield 200 may be directly electrically connected to the side shield 202. Alternatively, the ground shield 200 may be electrically connected to the side shield 202 via the holder 214.

The side shield 202 includes mounting tabs 350 extending inward from the main body 330. The mounting tabs 350 are used to secure the side shield 202 to the holder member 216. The mounting tabs 350 may be received in tab openings 352 in the holder member 216. The mounting tabs 350 may engage the holder member 216 to electrically connect the side shield 202 to the holder 214.

In an exemplary embodiment, when the contact module 122 is assembled, the grounding fingers 340 are offset horizontally and vertically with respect to the grounding beams 302. The grounding fingers 340 may extend along the sides of the receptacle signal contacts 124. The grounding fingers 340 may provide shielding between the receptacle signal contacts 124 and receptacle signal contacts 124 of an adjacent contact module 122 held in the receptacle assembly 102. The grounding fingers 340 may be horizontally aligned with receptacle signal contacts 124 in a corresponding row of the receptacle signal contacts 124. The grounding fingers 340 may be vertically offset, such as below, the receptacle signal contacts 124.

The second side shield 204 is separate and distinct from the ground shield 200 and the first side shield 202. The side shield 204 is manufactured from a metal material. In an exemplary embodiment, the side shield 204 is stamped and formed. The side shield 204 includes a main body 360 extending between a top 362 and a bottom 364. The side shield 204 is configured to be coupled to the side wall 223 of the holder member 218. The side shield 204 is coupled to the holder member 218 at the front 226 of the holder 214. Optionally, the holder member 218 may include a pocket 366 that receives the side shield 204 such that an outer surface 368 of the side shield 204 is generally flush with the side wall 223.

The side shield 204 includes a plurality of grounding fingers 370 extending forward from the main body 360. The grounding fingers 370 extend forward of the front 226 of the holder 214 for electrical connection to the header shield 146. The grounding fingers 370 are configured to be received in the front housing 120. The grounding fingers 370 have mating interfaces 372 at distal ends of the grounding fingers 370. In an exemplary embodiment, the grounding fingers 370 have bumps 374 proximate to the distal ends that are upward facing and that define the mating interfaces 372. The mating interfaces 372 are configured to engage the edges 162 (shown in FIG. 1) of corresponding header shields 146. Optionally, the side shield 204 may be selectively plated, such as at the mating interface 372 to enhance the characteristics of the side shield 204.

The side shield 204 includes mounting tabs 380 extending inward from the main body 360. The mounting tabs 380 are used to secure the side shield 204 to the holder member 218. The mounting tabs 380 may be received in tab openings 382 in the holder member 218. The mounting tabs 380 may engage the holder member 218 to electrically connect the side shield 204 to the holder 214.

The side shield 204 includes mounting tabs 384 extending inward from the main body 360. The mounting tabs 384 are used to secure the side shield 204 to the holder member 218. The mounting tabs 384 may be received in tab openings 386 in the holder member 218. The mounting tabs 384 include protrusions 388 that engage the holder member 218 in the tab openings 386 to electrically connect the side shield 204 to the holder 214.

In an exemplary embodiment, when the contact module 122 is assembled, the grounding fingers 370 are offset horizontally and vertically with respect to the grounding beams 302. The grounding fingers 370 may extend along the sides of the receptacle signal contacts 124. The grounding fingers 370 may provide shielding between the receptacle signal contacts 124 and receptacle signal contacts 124 of an adjacent contact module 122 held in the receptacle assembly 102. The grounding fingers 370 may be horizontally aligned with receptacle signal contacts 124 in a corresponding row of the receptacle signal contacts 124. The grounding fingers 370 may be vertically offset, such as below, the receptacle signal contacts 124.

Figure 3:
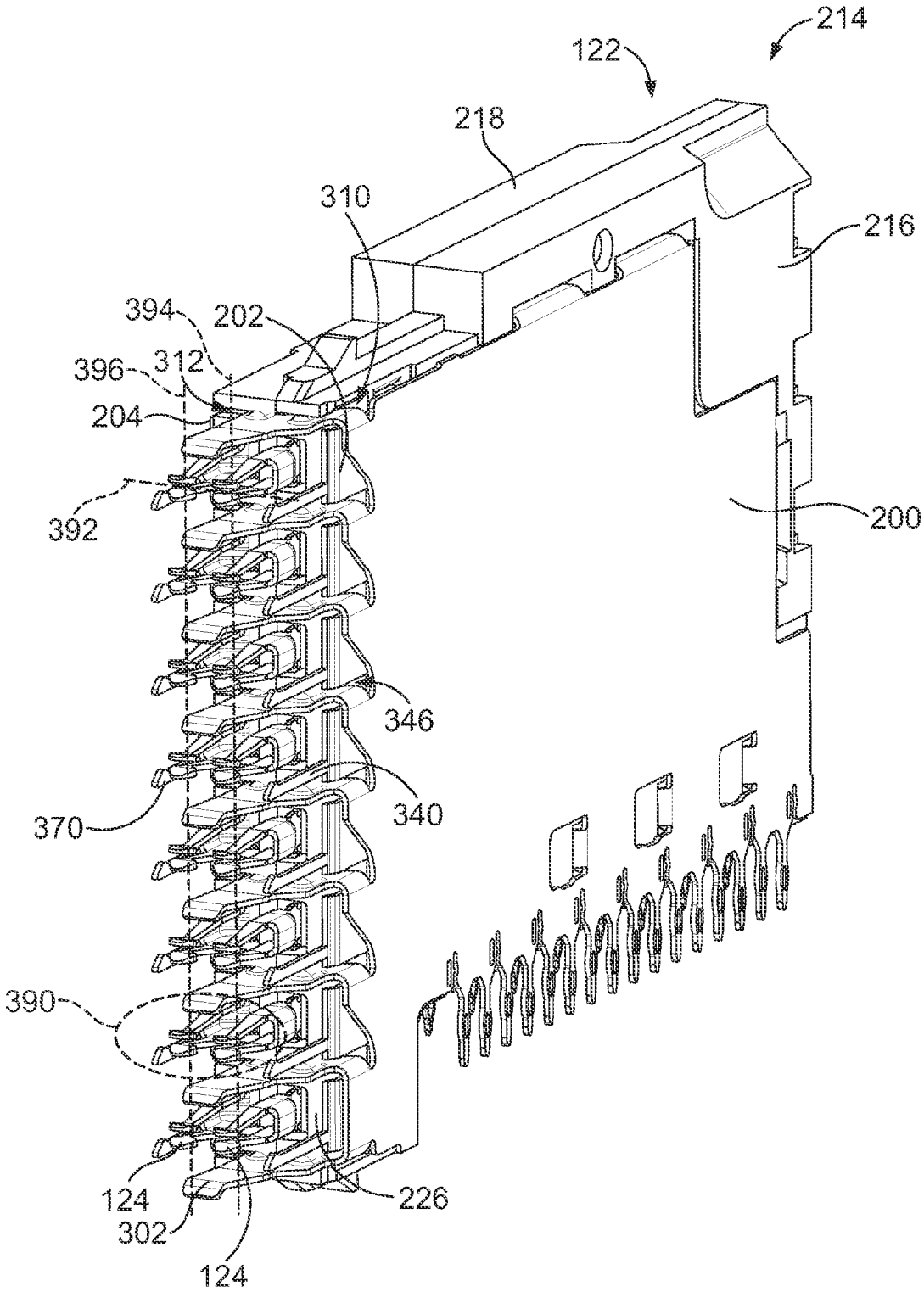
FIG. 3 is a perspective view of the contact module shown in FIG. 2 in an assembled state.

FIG. 3 is a perspective view of one of the contact modules 122 in an assembled state. During assembly, the dielectric frames 240, 242 (shown in FIG. 2) are received in the corresponding holder members 216, 218. The holder members 216, 218 are coupled together and generally surround the dielectric frames 240, 242. The dielectric frames 240, 242 are aligned adjacent one another such that the receptacle signal contacts 124 are aligned with one another and define contact pairs 390. Each contact pair 390 is configured to transmit differential signals through the contact module 122. The receptacle signal contacts 124 within each contact pair 390 are arranged in rows that extend along row axes 392. The receptacle signal contacts 124 within the dielectric frame 240 are arranged within a column along a column axis 394. Similarly, the receptacle signal contacts 124 of the dielectric frame 242 are arranged in a column along a column axis 396.

The ground shield 200 and side shields 202, 204 are coupled to the holder 214 to provide shielding for the receptacle signal contacts 124. When assembled, the ground shield 200 is positioned exterior the side shield 202 and covers a portion of the side shield 202. Alternatively, the ground shield 200 may be positioned interior of the side shield 202. The grounding beams 302 extend through the slots 346 and into the slots 310, 312. The ground shield 200 and side shields 202, 204 are also configured to electrically connect to the header shields 146 when the receptacle assembly 102 is coupled to the header assembly 104 (both shown in FIG. 1).

The grounding beams 302 provide shielding for the receptacle signal contacts 124 in both the dielectric frame 240 and the dielectric frame 242. The grounding beams 302 are aligned with the contact pairs 390 along both the column axis 394 and the column axis 396. In an exemplary embodiment, one grounding beam 302 is provided below the lowermost contact pair 390, another grounding beam 302 is provided above the uppermost contact pair 390, and grounding beams 302 are provided between each of the contact pairs 390. Each of the contact pairs 390 is thereby shielded both above and below its respective row axis 392.

The grounding fingers 340, 370 extend forward from the front 226 along the sides of the contact pairs 390. The grounding fingers 340, 370 are generally aligned with the contact pairs 390 along the row axes 392. The grounding fingers 340, 370 are vertically offset with respect to the grounding beams 302. During use, the grounding fingers 340, 370 are generally aligned horizontally with the contact pairs 390 while the grounding beams 302 are positioned vertically between the contact pairs 390. The grounding fingers 340, 370 are vertically offset with respect to the grounding beams 302. For example, the grounding beams 302 are generally aligned with the column axes 394, 396, while the grounding fingers 340, 370 are offset horizontally outside of the column axes 394, 396.

Figure 4:
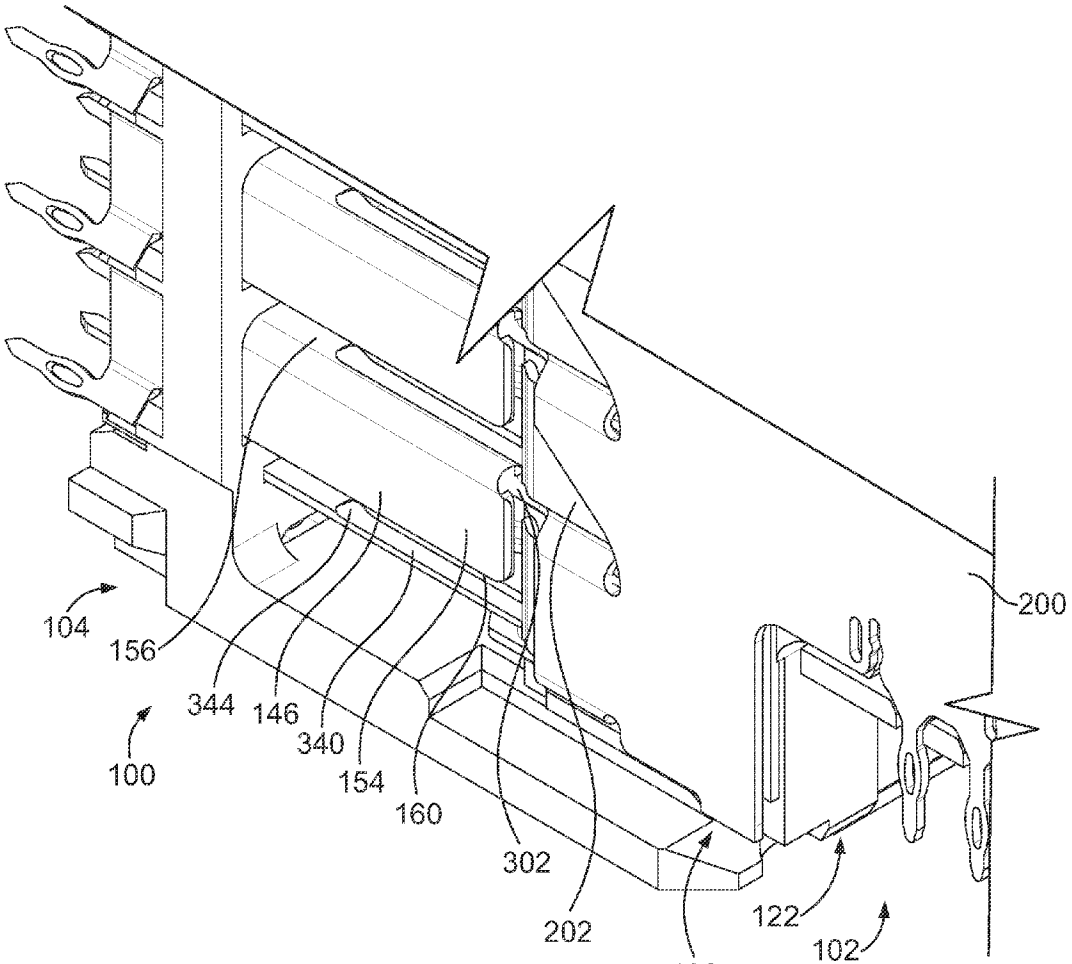
FIG. 4 is a partial sectional view of the electrical connector system showing the receptacle assembly mated to the header assembly.

FIG. 4 is a partial sectional view of the electrical connector system 100 showing the receptacle assembly 102 mated to the header assembly 104. Portions of the receptacle assembly 102 and header assembly 104 are removed to illustrate the grounding electrical connection between the shield structure 126 and the header shields 146. FIG. 4 illustrates the ground shield 200 and side shield 202 electrically connected to corresponding header shields 146. The side shield 204 (shown in FIG. 2) is electrically connected to the header shields 146 in a similar manner as the side shield 202.

The front housing 120 (shown in FIG. 1) of the receptacle assembly 102 has been removed for clarity to show the header shields 146 as well as the ground shield 200 and the side shield 202. When mated, the header shields 146 extend into the front housing 120 to engage the ground shield 200 and the side shield 202. The grounding beams 302 engage the top wall 156 of the C-shaped header shields 146 to make electrical connection therewith. The grounding fingers 340 engage the edges 160 of the C-shaped header shields 146 to make electrical connection therewith.

In an exemplary embodiment, the grounding beams 302 and the grounding fingers 340 are deflectable and are configured to be spring biased against the header shields 146 to ensure electrical connection with the header shields 146. The bumps 344 on the grounding fingers 340 are upward facing and engage the bottom edge 160 to ensure electrical connection between the side shield 202 and the header shield 146.

In an exemplary embodiment, the header shields 146 and the shield structure 126 provide 360° shielding for the receptacle signal contacts 124. For example, the side walls 154 and the grounding fingers 340 both extend along the side of the receptacle signal contacts 124 to provide shielding along the sides of the receptacle signal contacts 124 between the columns of the receptacle signal contacts 124, such as between receptacle signal contacts 124 held within different contact modules 122. The grounding beams 302 and the top walls 156 both extend along the receptacle signal contacts 124. The top walls 156 provide shielding between receptacle signal contacts 124 in different rows.

The shield structure 126 has multiple, redundant points of contact with each of the C-shaped header shields 146. For example, three points of contact are defined by the grounding fingers 340, 370 (shown in FIG. 3) and the grounding beam 302. The electrical performance of the electrical connector system 100 is enhanced with multiple ground contact points to the C-shaped header shield 146, as compared to systems that have a single ground contact point.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing configured for mating with a header assembly;

a contact module coupled to the front housing, the contact module including a conductive holder having a first side and an opposite second side, the conductive holder having a front coupled to the front housing, the conductive holder holding a frame assembly, the frame assembly comprising a plurality of contacts and a dielectric frame supporting the contacts, the dielectric frame being received in the conductive holder, the contacts extending from the conductive holder for electrical termination;

a ground shield coupled to the first side, the ground shield being electrically connected to the conductive holder, the ground shield having grounding beams extending therefrom, the grounding beams extending forward of the front of the conductive holder for electrical connection to a corresponding header shield of the header assembly; and first and second side shields coupled to the first and second sides, respectively, the first and second side shields being electrically connected to the conductive holder, the first and second side shields having grounding fingers extending therefrom, the grounding fingers extending forward of the front of the conductive holder for electrical connection to a corresponding header shield of the header assembly.

2. The receptacle assembly of claim 1, wherein the grounding beams and grounding fingers are configured to define at least three points of contact with each header shield.

3. The receptacle assembly of claim 1, wherein the grounding beams extend along at least one of tops or bottoms of corresponding contacts and the grounding fingers extend along opposite sides of corresponding contacts.

4. The receptacle assembly of claim 1, wherein the contacts are surrounded on four sides by corresponding grounding beams and grounding fingers.

5. The receptacle assembly of claim 1, wherein the contacts are arranged as differential pairs of contacts, the differential pairs of contacts are surrounded on four sides by corresponding grounding beams and grounding fingers.

6. The receptacle assembly of claim 1, wherein the grounding fingers are offset horizontally and vertically with respect to the grounding beams.

7. The receptacle assembly of claim 1, wherein the side shields include mounting tabs extending inward therefrom into channels formed in the conductive holder, the mounting tabs engaging the conductive holder to create an electrical connection with the conductive holder.

8. The receptacle assembly of claim 1, wherein the conductive holder includes first and second pockets in the first and second sides at the front that receive the first and second side shields, respectively, the first and second side shields being substantially flush with the first and second sides when received in the first and second pockets.

9. The receptacle assembly of claim 1, wherein the conductive housing includes a first holder member and a second holder member coupled to the first holder member, the frame assembly including a second dielectric frame holding a plurality of contacts, the second dielectric frame being received in the second holder member, the other dielectric frame being received in the first holder member and held adjacent the second dielectric frame, the first side shield being coupled to the first holder member, the second side shield being coupled to the second holder member.

10. The receptacle assembly of claim 9, wherein the contacts of the second dielectric frame are aligned along row axes with the contacts of the other dielectric frame, the grounding fingers of the first and second side shields being aligned with the contacts along corresponding row axes.

11. The receptacle assembly of claim 9, wherein the contacts of the second dielectric frame are aligned with one another along a second column axis, the contacts of the other dielectric frame being aligned with one another along a first column axis, the grounding beams being aligned with both the first and second column axes.

12. The receptacle assembly of claim 1, wherein the ground shield includes a plurality of ground pins extending from a bottom of the ground shield, the ground pins being configured to be terminated to a circuit board.

13. The receptacle assembly of claim 1, wherein the receptacle assembly comprises a plurality of the contact modules held by the front housing, the ground shields being positioned between adjacent contact modules.

14. A receptacle assembly comprising:

a front housing configured for mating with a header assembly, the front housing having contact openings therethrough;

a contact module coupled to the front housing, the contact module including a conductive holder having a first side and an opposite second side, the conductive holder having a front coupled to the front housing, the conductive holder holding a frame assembly, the frame assembly comprising a plurality of contacts and a dielectric frame supporting the contacts, the dielectric frame being received in the conductive holder, the contacts extending from the conductive holder into corresponding contact openings for electrical termination to header contacts of the header assembly;

a ground shield coupled to the first side, the ground shield being electrically connected to the conductive holder, the ground shield having grounding beams extending therefrom, the grounding beams extending forward of the front of the conductive holder into corresponding contact openings for electrical connection to a side wall of a corresponding C-shaped header shield of the header assembly; and first and second side shields coupled to the first and second sides, respectively, the first and second side shields being electrically connected to the conductive holder, the first and second side shields having grounding fingers extending therefrom, the grounding fingers extending forward of the front of the conductive holder into corresponding contact openings for electrical connection to corresponding edges of the C-shaped header shield of the header assembly.

15. The receptacle assembly of claim 14, wherein the grounding beams and grounding fingers are configured to define at least three points of contact with each header shield.

16. The receptacle assembly of claim 14, wherein the contacts are arranged as differential pairs of contacts, the differential pairs of contacts are surrounded on four sides by corresponding grounding beams and grounding fingers.

17. The receptacle assembly of claim 14, wherein the grounding fingers are offset horizontally and vertically with respect to the grounding beams.

18. The receptacle assembly of claim 14, wherein the side shields include mounting tabs extending inward therefrom into channels formed in the conductive holder, the mounting tabs engaging the conductive holder to create an electrical connection with the conductive holder.

19. The receptacle assembly of claim 14, wherein the conductive housing includes a first holder member and a second holder member coupled to the first holder member, the frame assembly including a second dielectric frame holding a plurality of contacts, the second dielectric frame being received in the second holder member, the other dielectric frame being received in the first holder member and held adjacent the second dielectric frame, the first side shield being coupled to the first holder member, the second side shield being coupled to the second holder member;

wherein the contacts of the second dielectric frame are aligned along row axes with the contacts of the other dielectric frame, the grounding fingers of the first and second side shields being aligned with the contacts along corresponding row axes; and wherein the contacts of the second dielectric frame are aligned with one another along a second column axis, the contacts of the other dielectric frame being aligned with one another along a first column axis, the grounding beams being aligned with both the first and second column axes.

20. An electrical connector assembly comprising:

a header assembly comprising a header housing, a plurality of header contacts held by the header housing, and a plurality of C-shaped header shields surrounding corresponding header contacts on three sides, the header shields having walls defining the C-shaped header shields and two edges at the ends of the C-shaped header shields; and a receptacle assembly matable to the header assembly, the receptacle assembly comprising:

a front housing matable to the header housing;

a contact module coupled to the front housing, the contact module including a conductive holder having a first side and an opposite second side, the conductive holder having a front coupled to the front housing, the conductive holder holding a frame assembly, the frame assembly comprising a plurality of contacts and a dielectric frame supporting the contacts, the dielectric frame being received in the conductive holder, the contacts extending from the conductive holder for electrical termination to corresponding header contacts;

a ground shield coupled to the first side, the ground shield being electrically connected to the conductive holder, the ground shield having grounding beams extending therefrom, the grounding beams extending forward of the front of the conductive holder for electrical connection to a corresponding wall of a corresponding header shield; and first and second side shields coupled to the first and second sides, respectively, the first and second side shields being electrically connected to the conductive holder, the first and second side shields having grounding fingers extending therefrom, the grounding fingers extending forward of the front of the conductive holder for electrical connection to corresponding edges of the header shield.

* * * * *